US008070390B2

(12) United States Patent
Castle

(10) Patent No.: US 8,070,390 B2
(45) Date of Patent: Dec. 6, 2011

(54) METHOD AND APPARATUS FOR REPAIRING PILES

(75) Inventor: William James Castle, Jobstown, NJ (US)

(73) Assignee: W. J. Castle, P.E. & Associates, P.C., Hainesport, NJ (US)

( * ) Notice: Subject to any disclaimer, the term of this patent is extended or adjusted under 35 U.S.C. 154(b) by 100 days.

(21) Appl. No.: 12/430,000

(22) Filed: Apr. 24, 2009

(65) Prior Publication Data

US 2009/0269145 A1 Oct. 29, 2009

Related U.S. Application Data

(60) Provisional application No. 61/047,611, filed on Apr. 24, 2008.

(51) Int. Cl.
*E02D 5/60* (2006.01)

(52) U.S. Cl. ..... 405/216; 405/211

(58) Field of Classification Search ..... 405/211, 405/216, 231, 232

See application file for complete search history.

(56) References Cited

U.S. PATENT DOCUMENTS

| | | | | |
|---|---|---|---|---|
| 2,874,548 | A | 2/1959 | Drushel | |
| 3,170,299 | A | 2/1965 | Clarke | |
| 3,690,110 | A | 9/1972 | Wiswell, Jr. | |
| 3,728,864 | A | 4/1973 | Wiswell, Jr. | |
| 3,736,759 | A | 6/1973 | Blöse | |
| 3,890,795 | A | 6/1975 | Maurer | |
| 3,934,422 | A | 1/1976 | Fredrickson et al. | |
| 3,939,665 | A | 2/1976 | Gosse | |
| 4,019,301 | A * | 4/1977 | Fox | 52/834 |
| 4,058,985 | A * | 11/1977 | Liddell | 405/216 |
| 4,068,483 | A | 1/1978 | Papworth | |
| 4,116,013 | A | 9/1978 | Hellmers | |
| 4,252,471 | A | 2/1981 | Straub | |
| 4,306,821 | A | 12/1981 | Moore | |
| 4,347,019 | A * | 8/1982 | Metz | 405/255 |
| 4,439,070 | A | 3/1984 | Dimmick | |
| 4,708,527 | A | 11/1987 | Inhofe, Jr. et al. | |
| 4,713,129 | A | 12/1987 | Inhofe, Jr. et al. | |
| 4,721,418 | A | 1/1988 | Queen | |
| 5,435,667 | A | 7/1995 | Strange | |
| 5,573,354 | A | 11/1996 | Koch | |
| 5,813,800 | A | 9/1998 | Doleshal | |
| 6,561,736 | B1 | 5/2003 | Doleshal | |
| 6,773,206 | B2 | 8/2004 | Bradley et al. | |
| 2003/0085482 | A1 | 5/2003 | Sincock et al. | |
| 2006/0245832 | A1 | 11/2006 | Anderson | |

FOREIGN PATENT DOCUMENTS

| | | | |
|---|---|---|---|
| GB | 2 177 148 | A | 1/1987 |
| JP | 61-010634 | A | 1/1986 |
| JP | 61-274012 | A | 1/1986 |

* cited by examiner

*Primary Examiner* — David Bagnell
*Assistant Examiner* — Benjamin Fiorello
(74) *Attorney, Agent, or Firm* — Flaster/Greenberg P.C.

(57) ABSTRACT

A method and apparatus for the repair of damaged piles and a repaired pile assembly, are included herein, wherein the method comprises providing a pile comprising a first pile side configured to define a first channel, and a second pile side configured to define a second channel. The pile has at least one damaged section. The method also includes providing at least two bent plates; attaching a first bent plate to the pile to fit within the first channel; and attaching a second bent plate to the pile to fit within the second channel. The bent plates overlap the damaged section. At least one cover plate is attached to at least one of: the pile, or the first and second bent plates, to form at least one compartment. Each compartment is then at least partially filled with a grout; and the grout is cured or allowed to cure.

13 Claims, 5 Drawing Sheets

METHOD AND APPARATUS FOR REPAIRING PILES

CROSS-REFERENCE TO RELATED APPLICATIONS

This application claims the benefit of priority under 35 U.S.C. §119(e) of U.S. Provisional Patent Application No. 61/047,611, filed Apr. 24, 2008, the entire disclosure of which is incorporated herein by reference.

BACKGROUND OF THE INVENTION

1. Field of the Invention

The present invention relates to the field of piles used in forming various structures, including a device and method for repairing damaged metal piles.

2. Description of Related Art

Piles of concrete, timber, steel or composite materials are an integral structural part of marine structures such as bridges, docks, piers, wharfs and the like. Piles, which are driven or jetted into the ground to some determined depth, support a structure above the water's surface. A disadvantage associated with metal or steel piles is that portions of the piles are susceptible to corrosion and/or degradation due at least in part to being located in a water environment, exposure to corrosive and/or salty air, impact from boats and other water vessels, and exposure to chemicals in the water, among other things. Even though steel piles are typically waterproofed prior to their installation, over a period of time, the waterproofing is usually not durable or protective enough to prevent the steel from corroding. Most of the damage to the piles tends to occur at the water line due to the wave action at that location. This wave action tends to be aggravated by the tides that are prevalent at many pile installations, where at high tide, water covers a greater height of the pile, while at low tide, a greater length of the pile is exposed to the air. Therefore, the piles undergo drying and wetting cycles that tend to contribute to further corrosion, thus weakening the piles at their mid sections.

While various encasement, wrapping and replacement techniques have emerged for the repair of the inevitable damage to steel piles, these techniques have some shortcomings. Encasement and wrapping may be suitable if the damage has not seriously compromised the structural integrity of the piles. However, for more serious damage, these practices are not particularly desirable as the structural strength of the repaired pile remains impaired. To repair more serious damage, a section of the pile may have to be replaced, or the pile may have to be replaced in its entirety. Furthermore, conventional replacement techniques tend to be costly, time and labor intensive, and complex.

U.S. Pat. No. 6,773,206 of DENSO™ North American Corporation describes the use of cylindrical fiber-form jackets, such as fiberglass or nylon, that are placed over the whole length of the pile to be repaired, or over the damage at the pile's tidal zone. The fiber-form jackets may be filled with concrete. The same patent also describes that the ROCKWATER Corporation in Farmingdale N.Y. discloses a similar system for damaged pile sections surrounded by fiberglass and nylon reinforced pile jackets filled with concrete. U.S. Pat. No. 6,773,206 also discloses a jacket having two halves that have been bolted together around a damaged pile. However, the fiberglass and nylon materials used in these jackets tend to be quite costly. Further, the jackets are hard to install, particularly underwater, making for an extremely cumbersome installation process, which makes such installation time consuming and labor intensive. Adding to these problems is that great care must be taken when handling fiberglass jackets, as they are quite delicate. Further, these jackets do not serve to significantly improve the structural strength of the repaired pile. In fact, the jackets tend to deteriorate over time, and may even separate and become detached from the pile, providing no compressive strength to the damaged pile at all. Additionally, these types of jackets, which are usually cylindrical, take up a lot of space. This in undesirable where repairs are being made under mud piles, as the large footprint created by the jacket may not fit within the confines of the area authorized by environmental permits for this type of installation. It is also known in the art, including U.S. Pat. No. 6,773,206, that a plastic jacket may be used with alternative filled jackets which suffer from many of the same issues associated with the fiber-form jackets.

U.S. Pat. No. 6,561,736 describes a coupler having steel sheathing members clamped against an H-pile in a particular configuration. An embodiment designed for H-piles further includes two channel members placed in each channel of the H-pile, and a locking bar member located along the longitudinal edge of the H-pile.

U.S. Pat. No. 5,813,800 describes an H-pile coupler having flat steel plates bolted to the flat sides of the H-pile, and a replacement H-pile section fastened to the flat steel plate reinforcement members. This patent teaches removal of the damaged pile section prior to installation of the coupler and replacement H-pile.

Even in view of the prior art designs, there remains a longstanding need in the art for alternative devices and methods for repairing piles which protect and structurally reinforce a pile.

BRIEF SUMMARY OF THE INVENTION

It is an object of the present invention to provide a method and apparatus for the repair of damaged piles which do not suffer from at least one of the abovementioned disadvantages associated with conventional methods and devices, and which also provide a repaired pile having improved strength.

The invention includes a method for repairing damaged steel piles comprising: (a) providing a pile comprising a first pile side configured to define a first channel, and a second pile side configured to define a second channel, wherein said pile has at least one damaged section; (b) providing at least two bent plates each comprising a front surface, a back face, and two side faces and having a bottom face; (c) attaching a first bent plate to the pile so as to fit within said first channel; (d) attaching a second bent plate to the pile so as to fit within said second channel, wherein said first and second bent plates overlap said damaged section; (e) attaching at least one cover plate to at least one of: said pile, or said first and second bent plates, so as to form at least one compartment; (f) at least partially filling each of said at least one compartments with a grout; and (g) curing or allowing said grout to cure.

The method may further include the step of attaching the bottom face to the bent plates prior to attaching the first bent plates to the pile. The method further may include providing at least one rebar rod which is placed within each of said compartments. The bent plates are preferably attached to said pile by bolts.

The bolts are preferably attached to said pile at points above and below said damaged pile section. The first and second bent plates may be pre-drilled with holes prior to attachment of the bent plates to said pile Further, the first and second bent plates are preferably bolted or otherwise fastened to opposite sides of said pile web through said pre-drilled holes.

The invention further includes an apparatus for repairing damaged steel piles comprising: (a) at least two bent plates each comprising a front surface, a back face, two side faces and a bottom face, wherein a first of said bent plates is configured for attachment to a first side of the pile within a first channel extending therethrough, and wherein a second of said bent plates is configured for attachment to a second side of the pile within a second channel extending therethrough, (b) at least one cover plate configured for attachment to at least one of: said pile or said first and second bent plates, to form at least one compartment; and (c) grout inserted within each of said compartments.

The apparatus may further comprise at least one rebar rod within the pile which is surrounded by said grout. The first and second bent plates are preferably both configured so as to be capable of being placed over a damaged section of said pile, and extend beyond said damaged section. The apparatus may also comprise fasteners for attaching said first and second bent plates to said first and second channel, preferably bolts.

The invention also includes a repaired pile assembly, comprising a pile having a first pile side configured to define a first channel, and a second pile side configured to define a second channel, said pile having at least one damaged section; a first and a second bent plate each comprising a front surface, a back face, and two side faces and having a bottom face, wherein the first bent plate is attached to the pile so as to fit within said first channel and the second bent plate is attached to the pile so as to fit within said second channel, and wherein said first and second bent plates overlap said damaged section; at least one cover plate attached to at least one of said pile, the first bent plate or the second bent plate, so as to form at least one compartment; wherein each of the at least one compartments is at least partially filled with a cured grout.

BRIEF DESCRIPTION OF THE SEVERAL VIEWS OF THE DRAWING(S)

The foregoing summary, as well as the detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
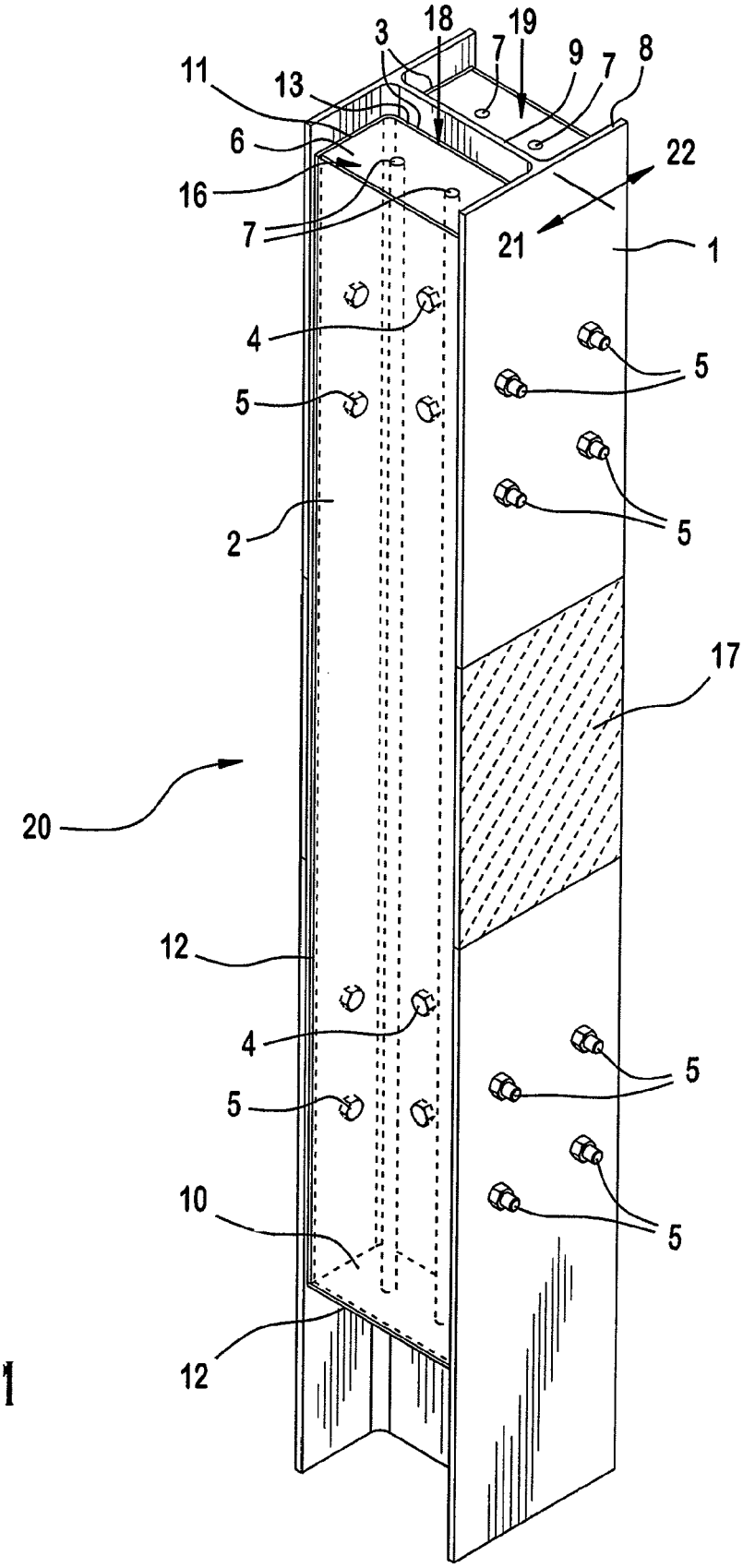
FIG. 1 is a perspective view of a pile repair apparatus in accordance with an embodiment of the invention.

As used herein, words such as "up" and "down," "upper" and "lower," "inner" and "outer," "left" and "right" and words of similar import are used herein to describe the invention with respect to the various drawings and refer to directions in the drawings. They should be given their ordinary and customary meaning and not considered to be limiting.

The present invention includes a method and apparatus for repairing damaged steel piles. The method and apparatus provide a simple, cost effective, and quick way to repair damaged piles, whether such repair is performed above or below either the water line or the mud line. Further, installation of the apparatus may result in an increase in the strength of the damaged section of the pile such that the section gains a compressive strength that is the same as or higher than the strength of the section of pile prior to becoming damaged. In some cases, the compressive strength of the pile can be increased to as much as about 70%, or more, above the strength of the structurally sound pile prior to being damaged. This increased strength is particularly desirable because damaged piles can have little or no compressive strength in the area of damage, which decreases the overall structural integrity of the pile. Previously known repair methods that include only a jacket or a coupling around the pile tend not to provide the level of increased strength achievable with the method and apparatus of the invention. Further, the components of the apparatus of the present invention are very robust, therefore it is not necessary to take as much care during their installation as is required with installation of fiberglass and nylon jackets. Additionally, the configuration of the apparatus is closely aligned with that of the pile itself, eliminating the footprint issues regarding environmental permitting that tend to exist for conventional jackets.

The method of the present invention includes a variety of step, which if followed provide the apparatus of the invention as an end result. The steps may be carried out in any order as long as they result in a structure in accordance with the apparatus of the present invention.

One step of the method of the invention involves providing a pile. The pile may be an existing pile that forms a support for a structure such as for example a bridge, or other structure. The pile may be completely or partially surrounded by air, water or soil. The pile may have any configuration suitable for use with the method and apparatus of the invention. Suitable configurations according to the invention have at least two channels formed by the web and flanges of the pile, such as for example an H-pile, I-pile, and the like. The first channel is located on the first pile side, and the second channel is located on the second pile side. If one were to draw an imaginary dividing line longitudinally through the center of the pile web, the portion of the web transversely on one side of that line would represent the "first side" of the pile, and the portion of the web on the opposite side of the line would represent the "second side" of the pile. Thus if the pile has been constructed symmetrically, the first and second sides of the pile are essentially substantially the same configuration as each other. The internal surfaces of the flanges and the web on each side of the pile define a "channel."

In a preferred embodiment of the invention, the pile may be thoroughly cleaned prior to installation of the repair apparatus to remove scale, rust, deteriorated pile, and the like. Cleaning may be performed, for example, by scraping the pile with hand tools, or high pressure water blasting.

In another embodiment of the invention, the pile may have holes drilled in it prior to installation of the repair apparatus. The holes, which may be suitable for the installation of bolts, may be drilled or burnt into the pile as per AISC (American Institute of Steel Construction) specifications. Preferably the holes in the pile may be located on the pile flanges and/or web, preferably at locations above and below the damaged section of the pile. Preferably the holes may be situated in the same location as matching holes that may be present on the bent plates, enabling attachment of the bent plates to the pile, as described herein-below.

At least two bent plates are provided for placement within the pile channels. The bent plates may be made of any material capable of imparting protection and improved strength to the damaged pile. In a preferred embodiment of the invention, the bent plates may be made of steel or stainless steel, preferably hot dipped galvanized steel or stainless steel, such as for example steel or stainless steel having an ASTM designation of A36 or higher, for example A480 or A480M. Each bent plate has a front surface, a back face, two side faces and a bottom face. The "bottom face" of the bent plate is located on the lower portion of the bent plate. It may be attached to the bent plate either before or after attachment of the bent plate to the pile channel. In a preferred embodiment of the invention, the bottom plate may be attached to the bent plate so as to be substantially, if not completely, perpendicular to the back face and/or the side faces. The "front surface" of the bent plate is located at the very end of the side faces, and is therefore the face located furthest away from the back plate. The bent plates have a configuration such that they can fit within the pile channels and can be affixed thereto. Therefore the dimensions of each bent plate will vary depending upon the dimensions of the pile to which it is to be affixed. In one embodiment of the invention, the bent plate may have a thickness of at least about ⅛ inch, and preferably from about 3/16 inch to about ¼ inch.

As noted hereinabove, in one embodiment of the invention, the bent plates may have predrilled holes in the bent plate back face and/or side faces. These holes may be suitable for the insertion of bolts, screws or other fasteners that may be used to attach the bent plate to the pile, as described hereinbelow.

In a different embodiment of the invention, the bent plates may be painted or coated prior to their installation, to inhibit or prevent future deterioration of the bent plate. Alternatively, the bent plate may be hot dipped galvanized or constructed of stainless steel.

The bent plates are placed over at least one damaged section of pile, on either side of the damage. In other words, a first bent plate covering a damaged section on the first side of the pile will have a corresponding second bent plate on the opposite, or second side of the pile. Both of the bent plates will cover the damaged pile section, and overlap that damaged section. The extension of the bent plates beyond the damaged section ensures that there is a structurally sound portion of the pile onto which the bent plates can be attached.

The back face of the bent plate also may be attached to the pile web. Each of the two side faces of the bent plate may be attached to its corresponding pile flange. In a preferred embodiment of the invention, both the back and the side faces of the bent plate are attached to the pile so as to fit within the pile channel. The method of attachment of the bent plate to the faces forming the pile channel may vary. Examples of suitable methods of attachment include adhesion, welding, nuts and bolts and the like, with the latter being preferred. In those embodiments of the invention in which bolts are used, it is preferred that the bolts be made of hot dipped galvanized high strength steel or stainless steel, for example bolts having an ASTM designation of A325 or A490. While the bolts may have any suitable diameter, ¾ inch bolts are preferred.

In a different step of the method of the invention, at least one cover plate is attached to the pile or the bent plates, or both. In one embodiment of the invention, a cover plate may be attached to the front surface of the bent plate. In another embodiment of the invention, the cover plate may be attached to the side faces of the bent plate, at the end of the side faces located furthest from the back face. In a different embodiment of the invention, the cover plate may be attached to the front faces of the piles. In yet another embodiment of the invention, multiple cover plates may together encircle the pile. For example, in this embodiment, one cover plate encircling one pile side may be attached at its seam to the seam of a second cover plate encircling the other pile side. The location of attachment of the cover plates is not particularly important, as long as the cover plate, together with the pile channel, creates a fillable chamber within the confines of the pile channel.

Once the cover plates on the first and second pile sides have been attached (whether releasably or permanently), fillable compartments are formed by the cover plates and the pile channels. To further increase the strength of the pile section under repair, a grout may be poured into compartments formed by each of the cover plates. The grout at least partially fills each compartment. The grout may be for example, a concrete or epoxy grout, and the like. In a preferred embodiment of the invention, the grout may have a compressive strength of at least 3,000 psi. After placement within the compartments, the grout may be cured, or allowed to cure. In one embodiment of the invention, prior to such curing, a rebar may be placed in each of the compartments to further increase the strength of the repair.

Figure 2:
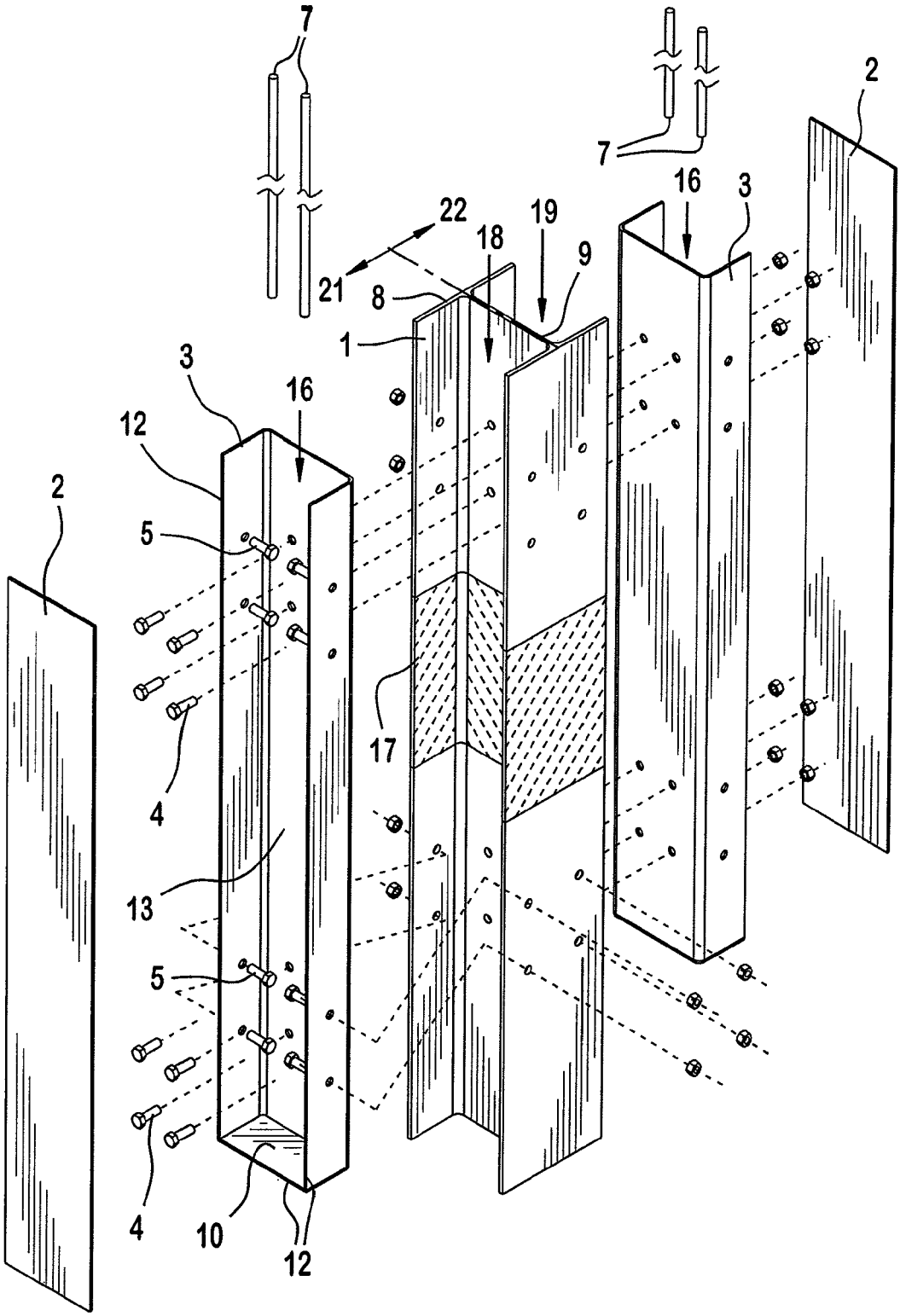
FIG. 2 is an exploded view of the repair apparatus shown in FIG. 1.
Figure 3:
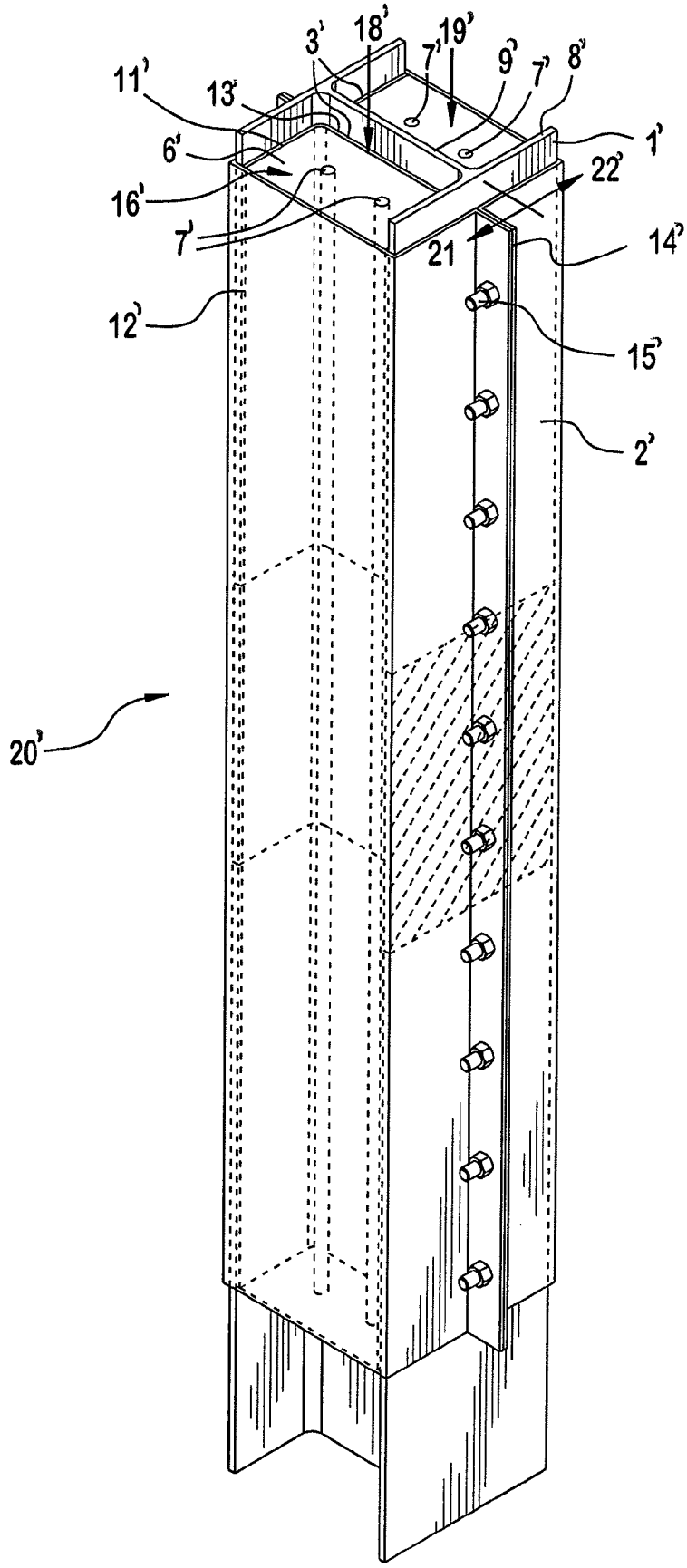
FIG. 3 is a perspective view of a pile repair apparatus in accordance with a different embodiment of the invention.

There is shown in FIG. 1 to FIG. 3 a pile repair apparatus, generally designated 20, 20' in accordance with embodiments of the invention. In the embodiment as shown in FIG. 1, the pile to be repaired is an H-pile 1 having a web 9, and flanges 8 situated at right angles to the web 9. On the first side 21 of the pile 20, is a first pile channel 18. The inside surfaces of the web 9 and the flanges 8 define the first pile channel 18. A bent plate 3, preferably formed of stainless steel, is attached to the first pile channel 18. The bent plate 3 has a front surface 12, a back face 13, two side faces 11 and a bottom face 10. The bottom face 10 of the bent plate 3 is preferably generally perpendicular to the back face 13 and the side faces. The back face 13 of the bent plate 3 is preferably attached to the pile web 9 by fasteners. As an example of such an attachment, bolts 4 may be used, for example, and inserted into holes in the bent plate 3 that were drilled in the bent plate back face 13 prior to installation of the bent plate 3 in the first pile channel 18. The side faces 11 of the bent plate 3 are attached to the pile flanges 8 also by fasteners, such as by bolts 5 inserted in holes in the bent plate 3 that were preferably drilled in the bent plate side faces 11 prior to installation of the bent plate 3 in the first pile channel 18. In this embodiment of the invention, the front surface 12 of the bent plate 3 is positioned to be flush with the ends of the pile flanges 8.

In this embodiment of the invention, the bottom face 10 of the bent plate 3 was preferably welded onto or otherwise joined to the remainder of the bent plate 3 before the bent plate 3 was fastened, in this case bolted, into the first pile channel 18. The bent plate 3 is positioned so that it covers and extends past an area of deterioration 17 on the pile 1. The bolts 4 and 5 connecting the bent plate 3 within the first pile channel 18 are located on structurally sound portions of the pile 1 located above and below the area of deterioration 17, enabling a secure attachment of the bent plate 3 to the pile 1. A cover plate 2 has been joined to (preferably welded to) the ends of the bent plate side faces 11 and bottom face 10, so as to form a compartment 16. The compartment 16 contains preferably two rebar 7 rods surrounded by a concrete grout 6. FIG. 2 is an exploded view of the embodiment of the invention shown in FIG. 1.

FIG. 3 shows a further embodiment of the invention 20' that is the same as FIGS. 1 and 2, except that in FIG. 3, the cover plate 2' in FIG. 3 encircles the first side 21' of the pile 20'. The cover plate 2' and the first pile channel 18' form a compartment 16'. Each end of the cover plate 2' on the first side 21' of the pile 20' has a seam 14' that is attached, by fasteners such as bolts 15', to the seam 14' of a different cover plate 2' on the second side 22' of the pile 20'.

Figure 4:
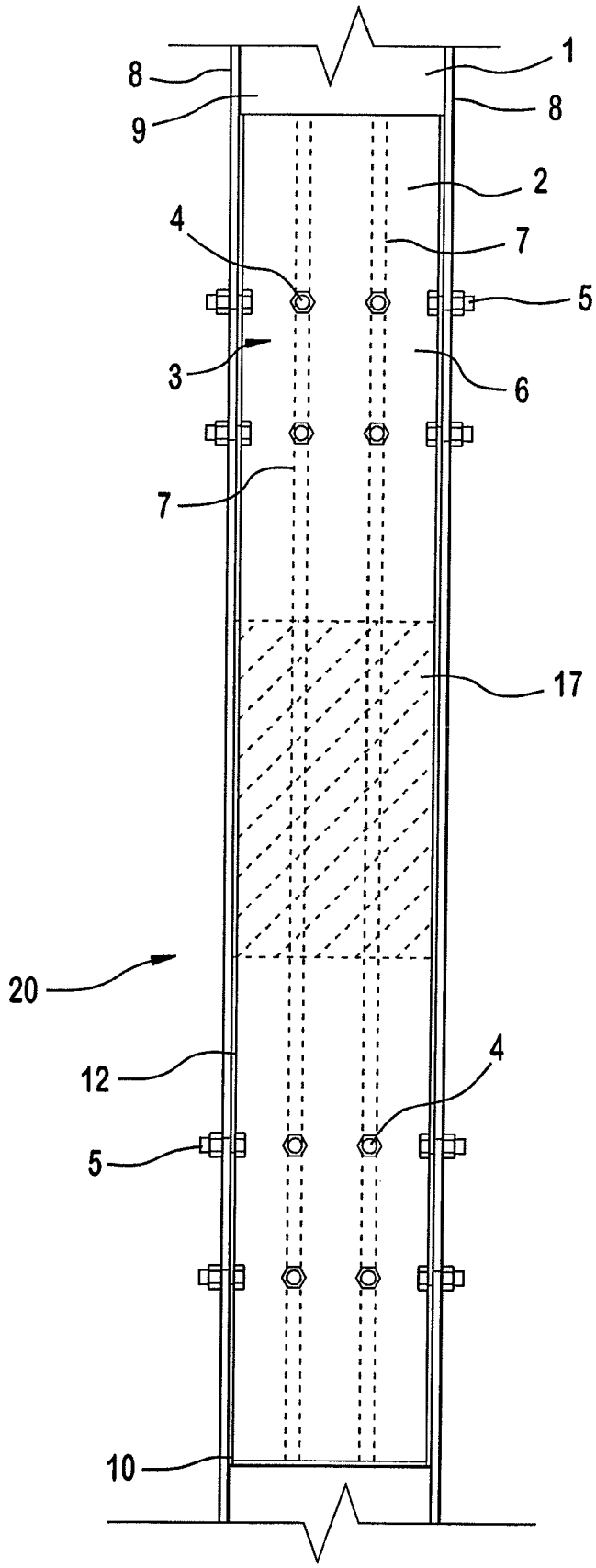
FIG. 4 is a front view of a pile repair apparatus in accordance with an embodiment of the invention.
Figure 5:
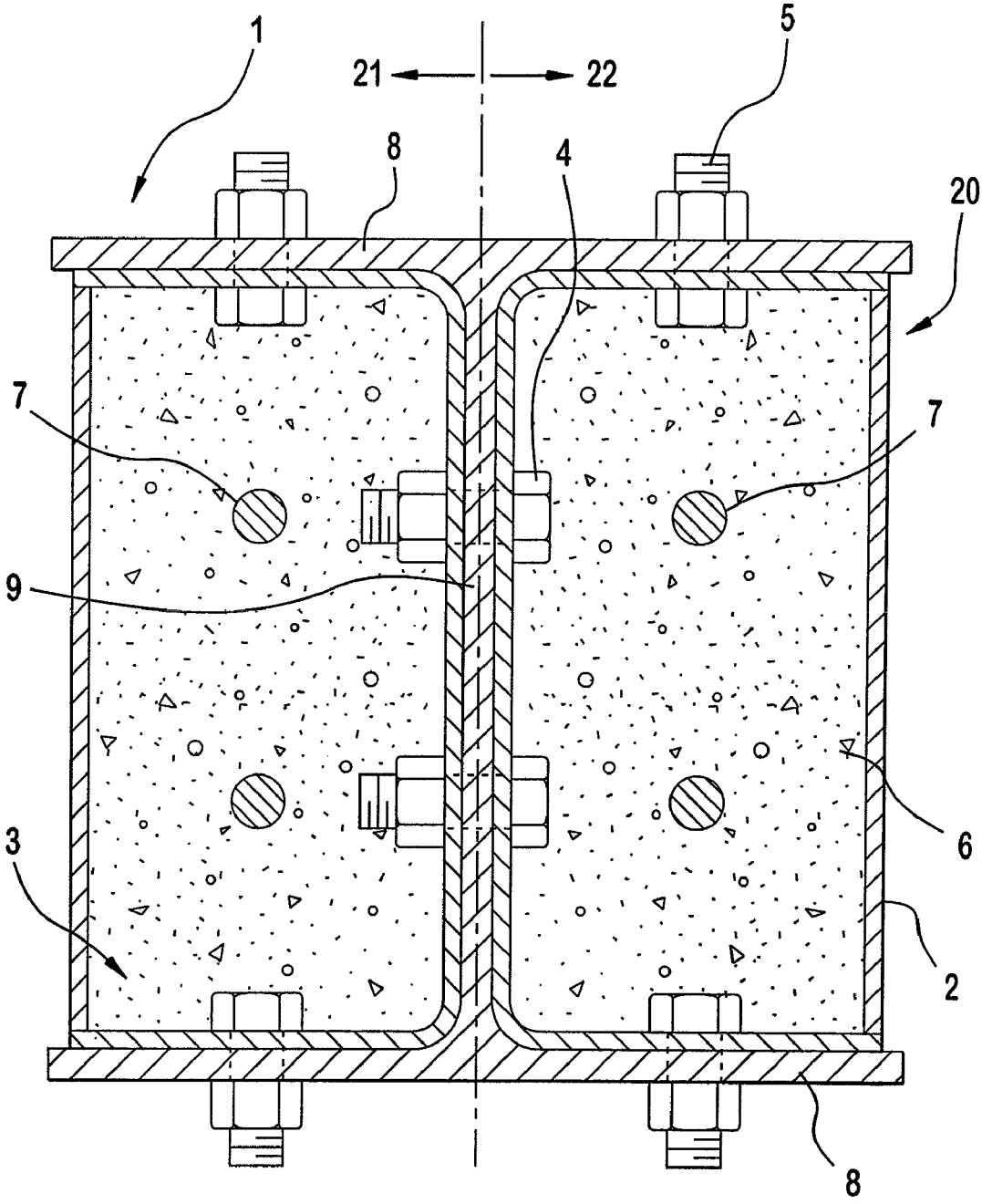
FIG. 5 is a top view of a pile repair apparatus in accordance with an embodiment of the invention.

FIG. 4. shows a front view of the first side 21 of the same pile repair apparatus 20 shown in FIG. 1, while FIG. 5 shows a top view of the pile repair apparatus 20 shown in FIG. 1. As shown in FIG. 5, the second side 22 of the pile 20 mirrors the first side 21 of the pile 20. Also, as can be seen in FIG. 5, in this embodiment of the invention, the bolts 4 extending through the bent plate 3 on the first side 21 of the pile 20 and then through the pile web 9, also extend through the bent plate 3 on the second side 22 of the pile 20, securing both bent plates 3 to the same location on the H-pile 1, on opposite sides of the pile 1. Just like the first pile channel 18, the second pile channel 19 has also been enclosed by a cover plate 2 to form a compartment 16 that contains two rebar 7 rods surrounded by a concrete grout 6.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A method for repairing damaged steel piles comprising:

a. providing a pile comprising a first pile side configured to define a first channel, and a second pile side configured to define a second channel,
wherein said pile has at least one damaged section;

b. providing at least two bent plates each comprising a front surface, a back face, and two side faces and having a bottom face;

c. attaching a first bent plate to the pile so as to be contained completely within said first channel;

d. attaching a second bent plate to the pile so as to be contained completely within said second channel,
wherein said first and second bent plates overlap said damaged section;

e. attaching at least one cover plate to at least one of: said pile, or said first and second bent plates, so as to form at least one compartment;

f. at least partially filling each of said at least one compartments with a grout; and g. curing or allowing said grout to cure.

2. The method according to claim 1, further comprising attaching the bottom face to the bent plates prior to attaching the first bent plates to the pile.

3. The method according to claim 1, wherein at least one rebar rod is placed within each of said compartments.

4. The method according to claim 1, wherein said bent plates are attached to said pile by bolts.

5. The method according to claim 4, wherein said bolts are attached to said pile at points above and below said damaged pile section.

6. The method according to claim 4, wherein said first and second bent plates are pre-drilled with holes prior to attachment of the bent plates to said pile.

7. The method according to claim 6, wherein said first and second bent plates are bolted to opposite sides of said pile web through said pre-drilled holes.

8. An apparatus for repairing damaged steel piles comprising:

a. at least two bent plates each comprising a front surface, a back face, two side faces and a bottom face,
wherein a first of said bent plates is configured for attachment to a first side of the pile so the first bent plate is contained completely within a first channel extending therethrough, and
wherein a second of said bent plates is configured for attachment to a second side of the pile so the second bent plate is contained completely within a second channel extending therethrough, b. at least one cover plate configured for attachment to at least one of: said pile or said first and second bent plates, to form at least one compartment; and c. grout inserted within each of said compartments.

9. The apparatus according to claim 8, further comprising at least one rebar rod within the pile which is surrounded by said grout.

10. The apparatus according to claim 8, wherein said first and second bent plates are both configured so as to be capable of being placed over a damaged section of said pile, and extend beyond said damaged section.

11. The apparatus according to claim 8, further comprising fasteners for attaching said first and second bent plates to said first and second channel.

12. The apparatus according to claim 11, wherein the fasteners are bolts.

13. A repaired pile assembly, comprising a pile having a first pile side configured to define a first channel, and a second pile side configured to define a second channel, said pile having at least one damaged section;

a first and a second bent plate each comprising a front surface, a back face, and two side faces and having a bottom face, wherein the first bent plate is attached to the pile so as to be contained completely within said first channel and the second bent plate is attached to the pile so as to be contained completely within said second channel, and wherein said first and second bent plates overlap said damaged section;

at least one cover plate attached to at least one of said pile, the first bent plate or the second bent plate, so as to form at least one compartment;

wherein each of the at least one compartments is at least partially filled with a cured grout.

* * * * *